US011611153B2

(12) United States Patent
Kuo et al.

(10) Patent No.: US 11,611,153 B2
(45) Date of Patent: Mar. 21, 2023

(54) ANTENNA FOR SUPPRESSING THE GAIN OF SIDE LOBES

(71) Applicant: ARCADYAN TECHNOLOGY CORPORATION, Hsinchu (TW)

(72) Inventors: Shin-Lung Kuo, Hsinchu (TW); You-Chu Chen, Hsinchu (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 56 days.

(21) Appl. No.: 17/110,349

(22) Filed: Dec. 3, 2020

(65) Prior Publication Data

US 2022/0059937 A1 Feb. 24, 2022

(30) Foreign Application Priority Data

Aug. 24, 2020 (TW) ..... 109128818

(51) Int. Cl.
*H01Q 13/20* (2006.01)
*H01Q 21/00* (2006.01)
(Continued)

(52) U.S. Cl.
CPC ..... *H01Q 21/0075* (2013.01); *H01Q 1/3233* (2013.01); *H01Q 13/206* (2013.01); *H01Q 21/22* (2013.01)

(58) Field of Classification Search
CPC .... H01Q 5/371; H01Q 13/206; H01Q 21/061; H01Q 1/3233; H01Q 21/0075; H01Q 21/065; H01Q 1/48; H01Q 1/38; H01Q 21/28; H01Q 1/243; H01Q 13/18; H01Q 1/521; H01Q 1/50; H01Q 5/392;
(Continued)

(56) References Cited

U.S. PATENT DOCUMENTS 4,180,817 A * 12/1979 Sanford ..... H01Q 25/004 343/700 MS
4,203,116 A * 5/1980 Lewin ..... H01Q 13/206 343/846

(Continued)

FOREIGN PATENT DOCUMENTS

CN 205303682 U * 6/2016
CN 210379423 U * 4/2020

(Continued)

*Primary Examiner* — Ab Salam Alkassim, Jr.
(74) *Attorney, Agent, or Firm* — Lin & Associates Intellectual Property, Inc.

(57) ABSTRACT

An antenna for suppressing the gain of side lobes includes a substrate, tandem antenna units arranged on the substrate and each including a first feed line and radiating elements, and the width of the radiating elements decreasing gradually from the middle of the first feed line to the two ends; and a power divider disposed on the substrate and including a feeding port, a second feed line with middle connected to the feeding port, and transmission lines, connected to the second feed line respectively. The output powers of the transmission lines decrease gradually from the middle of the second feed line to the two ends, and the transmission lines are respectively connected to the first feed lines. Thereby, the present invention can effectively suppress the gain of the side lobe both in YZ plane and the XZ plane, and improve target detection.

6 Claims, 8 Drawing Sheets

(51) Int. Cl.
*H01Q 1/32* (2006.01)
*H01Q 21/22* (2006.01)

(58) Field of Classification Search
CPC ..... H01Q 7/00; H01Q 9/36; H01Q 13/10; H01Q 3/40; H01Q 5/307; H01Q 9/04; H01Q 1/24; H01Q 1/084; H01Q 1/12; H01Q 1/2291; H01Q 1/242; H01Q 21/062; H01Q 21/205; H01Q 5/10; H01Q 5/335; H01Q 5/378; H01Q 9/16; H01Q 9/28; H01Q 9/42; H01Q 1/525; H01Q 19/26; H01Q 21/068; H01Q 9/045; H01Q 9/32; H01Q 9/40; H01Q 1/36; H01Q 5/40; H01Q 1/246; H01Q 1/52; H01Q 25/001
See application file for complete search history.

(56) References Cited

U.S. PATENT DOCUMENTS 4,521,781 A * 6/1985 Campi ..... H01Q 13/206 342/372
4,644,360 A * 2/1987 Mead ..... H01Q 21/065 343/771
5,422,649 A * 6/1995 Huang ..... H01Q 13/206 343/700 MS
5,712,644 A * 1/1998 Kolak ..... H01Q 13/206 343/700 MS
5,940,030 A * 8/1999 Hampel ..... H01Q 21/0006 342/368
6,014,112 A * 1/2000 Koscica ..... H01Q 1/246 343/822
6,094,172 A * 7/2000 Koscica ..... H01Q 13/206 343/731
6,147,658 A * 11/2000 Higashi ..... H01Q 3/12 333/167
6,686,867 B1 * 2/2004 Lissel ..... H01Q 25/002 343/753
11,201,381 B1 * 12/2021 Mruk ..... H01Q 21/0006
2004/0061647 A1 * 4/2004 Roper ..... H01Q 21/065 343/700 MS
2005/0259028 A1 * 11/2005 Koreyasu ..... H01Q 21/065 343/700 MS
2009/0009399 A1 * 1/2009 Gaucher ..... H01Q 21/0075 343/700 MS
2015/0253419 A1 * 9/2015 Alland ..... G01S 13/42 342/385
2019/0305415 A1 * 10/2019 Sharawi ..... H01Q 1/523
2020/0014116 A1 * 1/2020 You ..... H01Q 13/18
2020/0083611 A1 * 3/2020 Hasegawa ..... H01P 5/12
2021/0210842 A1 * 7/2021 Li ..... G01S 7/03
2022/0131274 A1 * 4/2022 Min ..... H01Q 13/206

FOREIGN PATENT DOCUMENTS

CN 212462022 U * 2/2021
CN 113471706 A * 10/2021
CN 215816341 U * 2/2022

* cited by examiner

ANTENNA FOR SUPPRESSING THE GAIN OF SIDE LOBES

CROSS-REFERENCE TO RELATED APPLICATION

This application claims the priority of Taiwanese patent application No. 109128818, filed on Aug. 24, 2020, which is incorporated herewith by reference.

BACKGROUND OF THE INVENTION

1. Field of the Invention

The present invention relates generally to an antenna, and more particularly, to an antenna for suppressing the gain of side lobes.

2. The Prior Arts

In order to improve driving safety, contemporary vehicles are equipped with systems such as blind spot detection, lane switching assistance, automatic distance control cruise, parking assistance, automatic braking, collision warning, and lane deviation detection. The above-mentioned systems are usually equipped with a vehicle radar, which can accurately and reliably detect and locate surrounding targets in any environment. The vehicle radar includes an antenna. The antenna usually uses the frequency modulated continuous wave (FMCW) principle to detect the distance and speed of the target to support the frequency band of the vehicle radar.

The narrower the beam of the array antenna in the radar, the higher the power, and the longer the sensing distance. The radiation pattern synthesized by the array antenna includes a main lobe and side lobes. The main lobe is the area around the maximum radiation direction, usually within 3 dB of the peak of the main beam, which is the main working direction of the radar. Side lobes are beams with small radiation around the main beam. These side lobes are usually undesired radiation directions, which can cause noise interference and ghost points in detection.

The antenna of a general vehicle radar includes a plurality of feed units and a plurality of antenna units. Each antenna unit includes a feed line and a plurality of radiating elements. The plurality of radiating elements are arranged on the feed line at intervals, and each radiating element is rectangular (i.e., a patch shape). Each feed unit includes a feeding port and a transmission line, one end of the transmission line is connected to the feeding port, and the other end of the transmission line is connected to one of the feed lines. By inputting current to the feed lines through the plurality of feed units simultaneously, the feed lines distribute the current to the plurality of radiating elements, so that the radiating elements can simultaneously emit electromagnetic waves. As such, the transmission power of the antenna of the vehicle radar can reach a required distance, for example, one hundred and fifty meters.

However, because the widths and lengths of the radiating elements are equal, the energy radiated by the radiating elements is equal, so that the resultant radiation pattern which is the gain of the side lobe on the radar's YZ plane (i.e., vertical plane) is larger, and therefore it is easy to detect objects outside the vertical direction of the target, such as, objects on the ground, resulting in poor resolution of detecting the target.

Furthermore, because the lengths of the flow path of current from the feeding ports through the transmission lines to the feed lines are equal, and the line widths of the transmission lines are equal, the output powers obtained by the antenna units are equal, so that for the synthesized radiation pattern, the gain of side lobes in the XZ plane (i.e., the azimuth plane) of the radar is large, and it is easy to detect objects outside the horizontal direction of the target, such as, road trees or telephone poles, resulting in poor resolution of detecting the target.

In addition, the structure of the conventional antenna is complicated and the manufacturing cost is high.

SUMMARY OF THE INVENTION

A primary objective of present invention is to provide an antenna for suppressing the gain of side lobes, which can effectively suppress both the gain of side lobes in the YZ plane (i.e., vertical surface) and the gain of the side lobes in the XZ plane (i.e., azimuth plane) to improve the resolution of detecting targets.

Another objective of the present invention is to provide an antenna for suppressing the gain of side lobes, which has a simple structure and low manufacturing cost.

In order to achieve the foregoing objectives, the present invention provides an antenna for suppressing the gain of side lobes, comprising: a substrate, a plurality of tandem antenna units, and a power divider; the tandem antenna units being arranged on the substrate at intervals, and each comprising a first feed line and a plurality of radiating elements; the radiating elements being arranged at intervals on the first feed line, and each radiating element being rectangular; widths of the radiating elements gradually decreasing from middle of the first feed line to both ends of the first feed line; the power divider being arranged on the substrate and comprising a feeding port, a second feed line and a plurality of transmission lines; the middle of the second feed line is connected to the feeding port; the transmission lines being respectively connected to the second feed line and arranged at intervals; output powers of the transmission lines gradually decreasing from middle of the second feed line to both ends of the second feed line, and the transmission lines being respectively connected to the first feed lines.

Preferably, the radiating elements form two radiation combinations from the middle of the first feed line to the two ends of the first feed line, each radiation combination comprises at least six radiating elements, and the width of the each of the at least six radiating elements of each radiation combination decreases gradually from the middle of the first feed line to one end of the first feed line.

Preferably, the at least six radiating elements of each radiation combination are sequentially defined as a first radiating element, a second radiating element, a third radiating element, a fourth radiating element, a fifth radiating element, and a sixth radiating element from the middle of the first feed line to one end of the first feed line. The widths of the first, second, third, fourth, fifth and sixth radiating elements are defined as W1, W2, W3, W4, W5 and W6 respectively. The relationship among the widths of the radiating elements is W1:W2:W3:W4:W5:W6=1.45:1.4:1.23:1.03:0.8:0.7.

Preferably, the at least six radiating elements of each radiation combination are sequentially defined as a first radiating element, a second radiating element, a third radiating element, a fourth radiating element, a fifth radiating element, and a sixth radiating element from the middle of the first feed line to one end of the first feed line; the widths of the first radiating elements are equal, the widths of the second radiating elements are equal, the widths of the third radiating elements are equal, the widths of the fourth radiating elements are equal, the widths of the fifth radiating elements are equal, the widths of the sixth radiating elements are equal, and the lengths of all the radiating elements of each tandem antenna unit are equal.

Preferably, the transmission lines form two output combinations from the middle of the second feed line to both ends of the second feed line, each output combination comprises at least four transmission lines, and the power outputs of the at least four transmission lines of each output combination decrease gradually from the middle of the second feed line to one end of the second feed line.

Preferably, the at least four transmission lines of each output combination are sequentially defined as a first transmission line, a second transmission line, a third transmission line, and a fourth transmission line from the middle of the second feed line to one end of the second feed line; the output power relationship among ratio of the first transmission line, the second transmission line, the third transmission line, and the fourth transmission line of the at least four transmission lines of each output combination is 1:0.75:0.39:0.24.

Preferably, the second feed line comprises a plurality of impedance distribution and impedance converters, the impedance distribution and impedance converters are respectively connected to the transmission lines; by adjusting the line width relationship among the transmission lines connected with the impedance distribution and impedance converters, the output power of the transmission lines can be made to gradually decrease from the middle of the second feed line to the two ends of the second feed line.

In order to achieve the foregoing objectives, the present invention provides an antenna for suppressing the gain of side lobes, comprising: a substrate, a plurality of tandem antenna units, and a power divider; the tandem antenna units being arranged on the substrate at intervals, and each comprising a first feed line and a plurality of radiating elements; the radiating elements being arranged at intervals on the first feed line, and each radiating element being rectangular; the radiating elements forming two radiation combinations from the middle of the first feed line to the two ends of the first feed line, each radiation combination comprising at least six radiating elements, the at least six radiating elements of each radiation combination being sequentially defined as a first radiating element, a second radiating element, a third radiating element, a fourth radiating element, a fifth radiating element, and a sixth radiating element from the middle of the first feed line to one end of the first feed line; widths of the first, second, third, fourth, fifth and sixth radiating elements being defined as W1, W2, W3, W4, W5 and W6 respectively with the relationship among the widths of the radiating elements being W1:W2:W3:W4:W5:W6=1.45:1.4:1.23:1.03:0.8:0.7; the power divider being arranged on the substrate and comprising a feeding port, a second feed line and a plurality of transmission lines; the middle of the second feed line is connected to the feeding port; the transmission lines being respectively connected to the second feed line and arranged at intervals; the transmission lines forming two output combinations from the middle of the second feed line to both ends of the second feed line, each output combination comprising at least four transmission lines, the at least four transmission lines of each output combination are sequentially defined as a first transmission line, a second transmission line, a third transmission line, and a fourth transmission line from the middle of the second feed line to one end of the second feed line; the output power relationship among the first transmission line, the second transmission line, the third transmission line, and the fourth transmission line of the at least four transmission lines of each output combination being 1:0.75:0.39:0.24; the plurality of transmission lines being connected respectively to the plurality of the first feed lines.

Preferably, the widths of the first radiating elements are equal, the widths of the second radiating elements are equal, the widths of the third radiating elements are equal, the widths of the fourth radiating elements are equal, the widths of the fifth radiating elements are equal, the widths of the sixth radiating elements are equal, and the lengths of all the radiating elements of each tandem antenna unit are equal.

Preferably, the second feed line comprises a plurality of impedance distribution and impedance converters, the impedance distribution and impedance converters are respectively connected to the transmission lines; by adjusting the line width relationship among the transmission lines connected with the impedance distribution and impedance converters, the output power of the transmission lines can be made to gradually decrease from the middle of the second feed line to the two ends of the second feed line.

The advantages of the present invention lie in that the antenna for suppressing the gain of side lobes according to the present invention can effectively suppress both the gain of side lobes in the YZ plane (i.e., vertical surface) and the gain of the side lobes in the XZ plane (i.e., azimuth plane) to improve the resolution of detecting targets.

Furthermore, the power divider only needs a single feeding port to integrate a plurality of serially tandem antenna units, which has a simple structure and low manufacturing cost.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
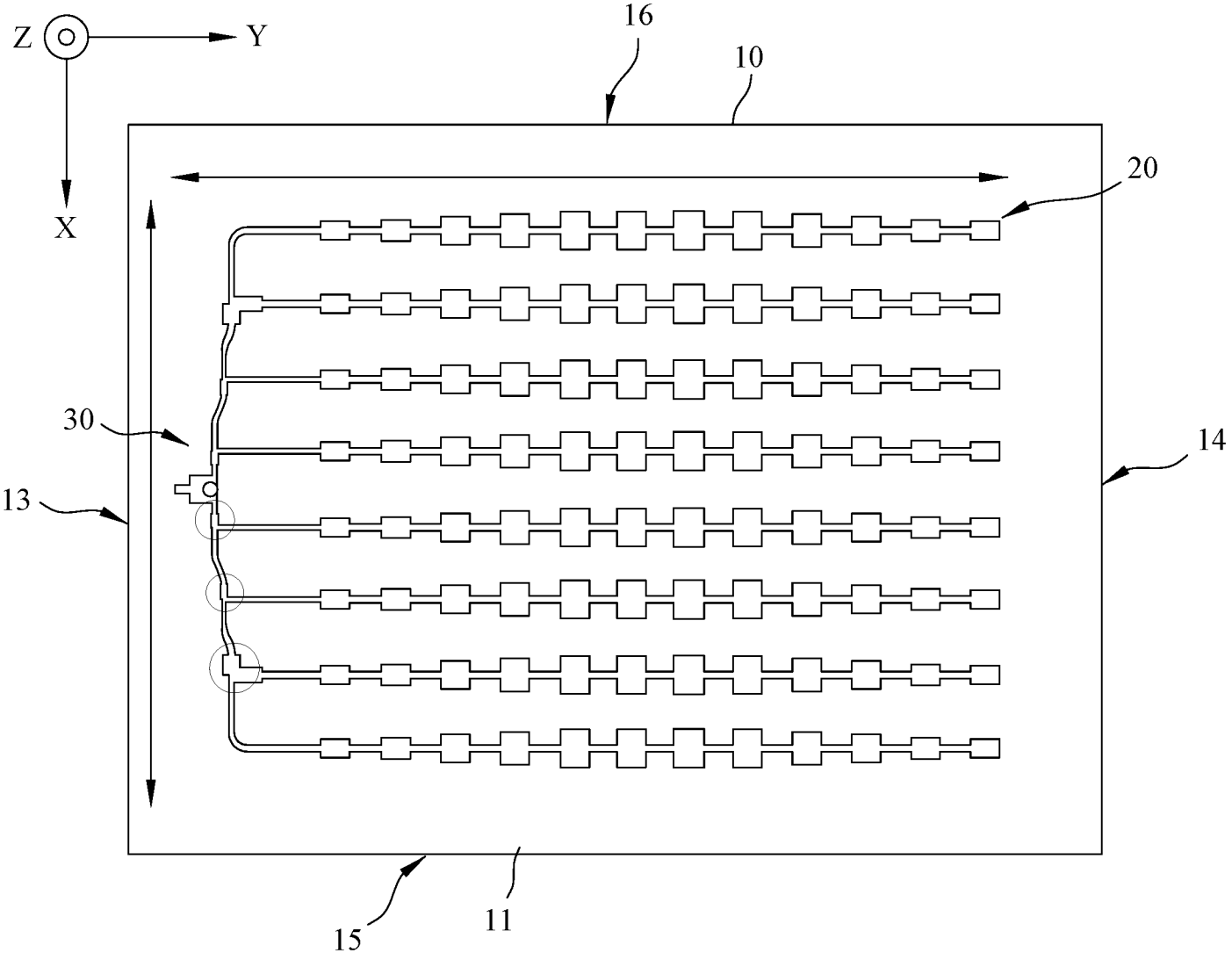
FIG. 1 is a schematic view illustrating an antenna for suppressing the gain of side lobes according to an embodiment of the present invention.

Referring to FIG. 1, FIG. 1 is a schematic view illustrating an antenna for suppressing the gain of side lobes according to an embodiment of the present invention. As shown in FIG. 1, the present invention provides an antenna for suppressing the gain of side lobes, which comprises a substrate 10, a plurality of tandem antenna units 20, and a power divider 30.

The two surfaces of the substrate 10 in a Z-axis direction are respectively defined as a first surface 11 and a second surface (not shown), and the two sides of the substrate 10 in a Y-axis direction are respectively defined as a first side 13 and a second side 14, and the two sides of the substrate 10 in an X-axis direction are defined as a third side 15 and a fourth side 16 respectively. More specifically, when the antenna for suppressing the gain of side lobes of the present invention is mounted on a sensor (not shown), the first surface 11 and the second surface of the substrate 10 are respectively facing the directions of the front and back sides of the sensor, the first side 13 and the second side 14 of the substrate 10 are respectively facing the directions of the bottom and top of the sensor, and the third side 15 and the fourth side 16 of the substrate 10 are respectively facing the directions of the left and right sides of the sensor. The substrate 10 is a composite material containing Teflon. However, the material of the substrate 10 is not limited to the above, and any material of the substrate 10 suitable as an antenna is suitable for application in the present invention.

The tandem antenna units 20 are arranged on the first surface 11 of the substrate 10 at intervals. The power divider 30 is disposed on the first surface 11 of the substrate 10.

Figure 2:
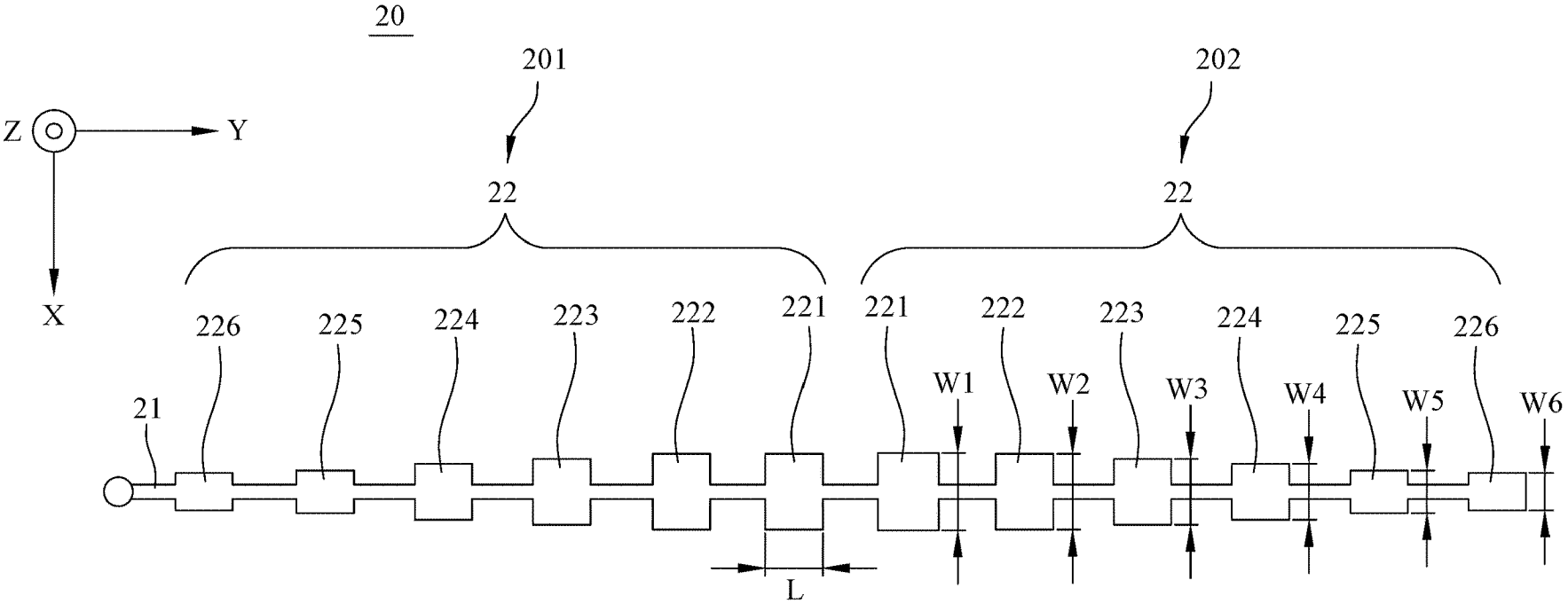
FIG. 2 is a schematic view illustrating the tandem antenna units according to an embodiment of the present invention.

Referring to FIG. 2, FIG. 2 is a schematic view illustrating the tandem antenna units according to an embodiment of the present invention. As shown in FIG. 2, each tandem antenna unit 20 comprises a first feed line 21 and a plurality of radiating elements 22. The radiating elements 22 are arranged on the first feed line 21 at intervals, and each radiating element 22 is rectangular (i.e., in a shape of a patch), the widths of the radiating elements 22 gradually decrease from the middle of the first feed line 21 to the two ends of the first feed line 21.

Figure 3:
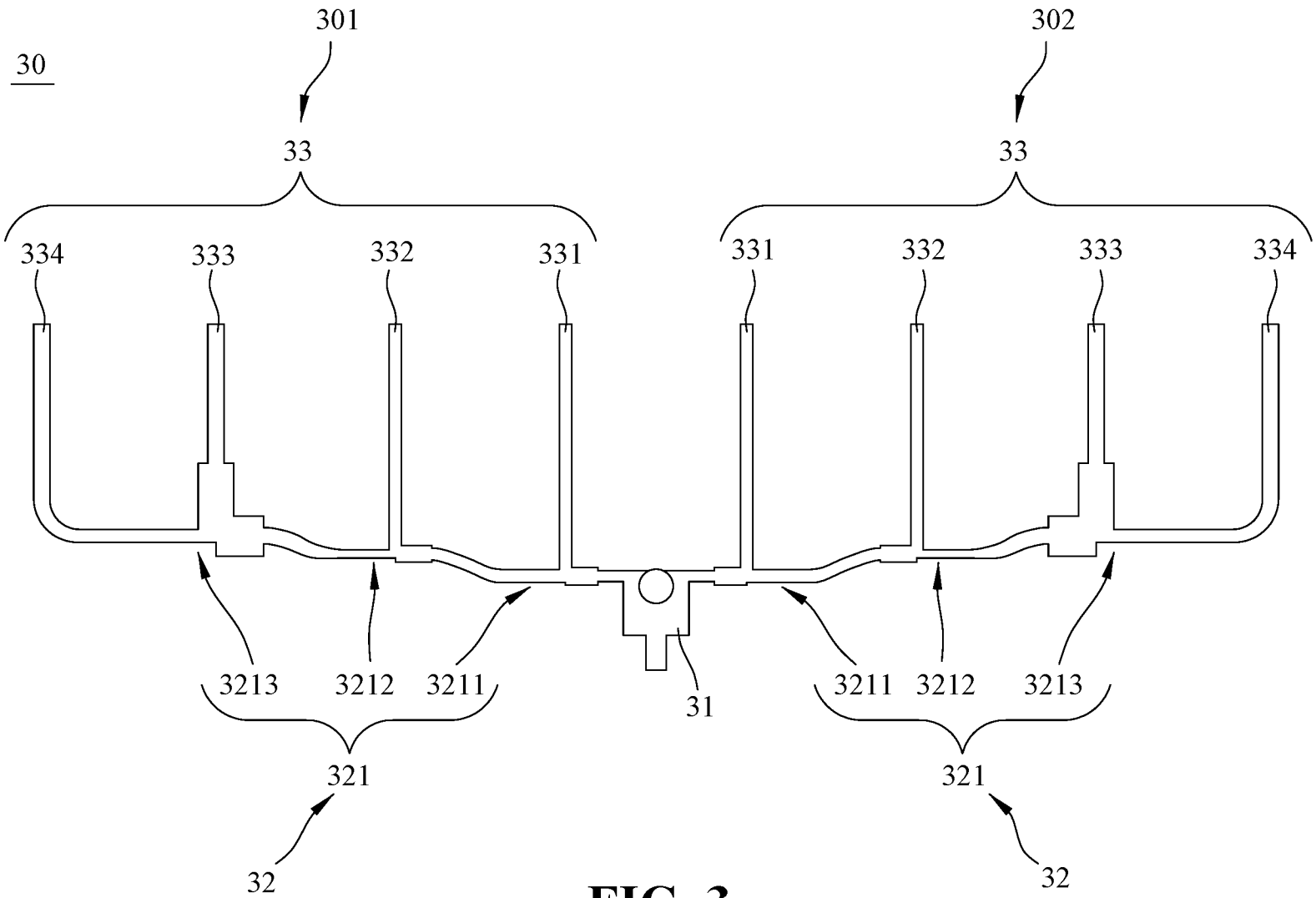
FIG. 3 is a schematic view illustrating the power divider according to an embodiment of the present invention.

Referring to FIG. 3, FIG. 3 is a schematic view illustrating the power divider according to an embodiment of the present invention. As shown in FIG. 3, the power divider 30 comprises a feeding port 31, a second feed line 32, and a plurality of transmission lines 33. The middle of the second feed line 32 is connected to the feeding port 31, and the transmission lines 33 are respectively connected to the second feed lines 32, and are arranged at intervals from each other. The output power of the transmission lines 33 gradually decreases from the middle of the second feed line 32 to the two ends of the second feed line 32. As shown in FIG. 1, the transmission lines 33 are respectively connected to the first feed lines 21.

As shown in FIG. 2, in a preferred embodiment, the radiating elements 22 form two radiation combinations 201, 202 from the middle of the first feed line 21 to the two ends of the first feed line 21, each radiation combination 201, 202 comprises at least six radiating elements 22, and the width of the each of the at least radiating elements 22 of each radiation combination 201, 202 decreases gradually from the middle of the first feed line 21 to one end of the first feed line 21. Specifically, the at least six radiating elements 22 of each radiation combination 201, 202 are sequentially defined as a first radiating element 221, a second radiating element 222, a third radiating element 223, a fourth radiating element 224, a fifth radiating element 225, and a sixth radiating element 226 from the middle of the first feed line 21 to one end of the first feed line 21. The widths of the first, second, third, fourth, fifth and sixth radiating elements are defined as W1, W2, W3, W4, W5 and W6 respectively. According to the Dolph-Chebyshev power ratio design, the relationship among the widths of the radiating elements is W1:W2:W3:W4:W5:W6=1.45:1.37:1.23:1.03:0.8:1.03 with an ideal condition. The present invention further optimizes the design by adjusting and fine tuning the line widths for better performance in a real life situation based on the ideal condition. Refer to the above-mentioned power relationship, and adjust the width of the second radiating element 222 of each radiation combination 201, 202 and reduce the width of the sixth radiating element 226 of each radiation combination 201, 202, and finally perform fine-tuning, so that the optimal width relationship among the radiating elements is W1:W2:W3:W4:W5:W6=1.45:1.4:1.23:1.03:0.8:0.7. However, the selected algorithm is not limited to the Dolph-Chebyshev power ratio, and any algorithm that can suppress the side lobe to an optimal width relationship of at least 15 dB or more can be applied to the present invention.

As shown in FIG. 2, in a preferred embodiment, the widths W1 of the first radiating elements 221 are equal, the widths W2 of the second radiating elements 222 are equal, the widths W3 of the third radiating elements 223 are equal, the widths W4 of the fourth radiating elements 224 are equal, the widths W5 of the fifth radiating elements 225 are equal, the widths W6 of the sixth radiating elements 226 are equal, and the lengths L of all the radiating elements 22 of each tandem antenna unit 20 are equal. In other words, the radiating elements 22 of each tandem antenna unit 20 are symmetrically distributed on the first feed line 21 of each tandem antenna unit 20 according to the width relationship.

Generally speaking, the unit of width of the radiating elements 22 is mm. Therefore, in a preferred embodiment, the optimal width W1 of the first radiating elements 221 is actually 1.45 mm, the optimal width W2 of the second radiating elements 222 is actually 1.4 mm, the optimal width W3 of the third radiating elements 223 is actually 1.23 mm, the optimal width W4 of the fourth radiating elements 224 is actually 1.03 mm, the optimal width W5 of the fifth radiating elements 225 is actually 0.8 mm, and the optimal width W6 of the sixth radiating elements 226 is actually 0.7 mm.

As shown in FIG. 3, in a preferred embodiment, the transmission lines 33 form two output combinations 301, 302 from the middle of the second feed line 32 to both ends of the second feed line 32, each output combination 301, 302 comprises at least four transmission lines 33. In other words, as shown in FIG. 1, the power divider 30 comprises eight transmission lines 33. The antenna for suppressing the gain of side lobes of the present invention comprises eight tandem antenna units 20, and the eight transmission lines 33 are respectively connected to the eight first feed lines 21. The output power of the four transmission lines 33 of each output combination 301, 302 gradually decreases from the middle of the second feed line 32 to one end of the second feed line 32. Specifically, the four transmission lines 33 of each output combination 301, 302 are sequentially defined from the middle of the second feed line 32 to one end of the second feed line 32 as a first transmission line 331, a second transmission line 332, a third transmission line 333, and a fourth transmission line 334. According to the Dolph-Chebyshev series design, the output power relationship among the first transmission line 331, the second transmission line 332, the third transmission line 333 and the fourth transmission line 334 of each output combination 301, 302 is 1:0.77:0.44:0.34 in an ideal condition. The present invention further optimizes the design by adjusting line width ratios described below for better performance and optimal output power relationship in a real life situation based on the ideal condition. Refer to the above power ratio relationship, and reduce the output power of the second transmission line 332, the third transmission line 333, and the fourth transmission line 334 of each output combination 301, 302, and finally fine-tune the output power of each output combination 301, 302. The optimal output power relationship among the first transmission line 331, the second transmission line 332, the third transmission line 333, and the fourth transmission line 334 is 1:0.75:0.39:0.24. However, the selected algorithm is not limited to the Dolph-Chebyshev series. Any algorithm for optimal output power relationship that can suppress the side lobe at least 15 dB or more can be applied to the present invention.

Figure 4:
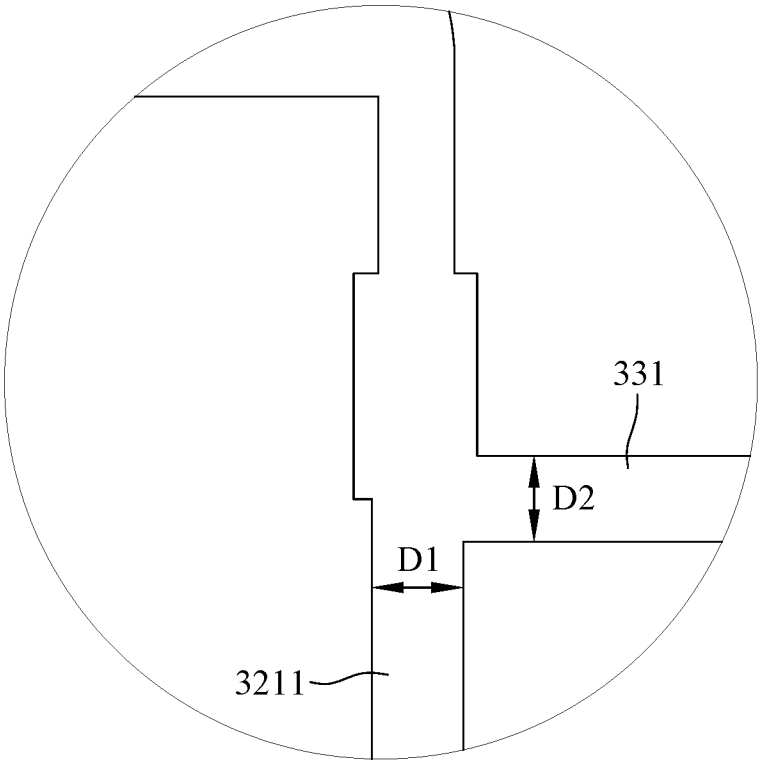
FIG. 4 is a schematic view illustrating the connection between the first impedance distribution and the impedance converter of the second feed line of the power divider with the first transmission line according to an embodiment of the present invention.
Figure 5:
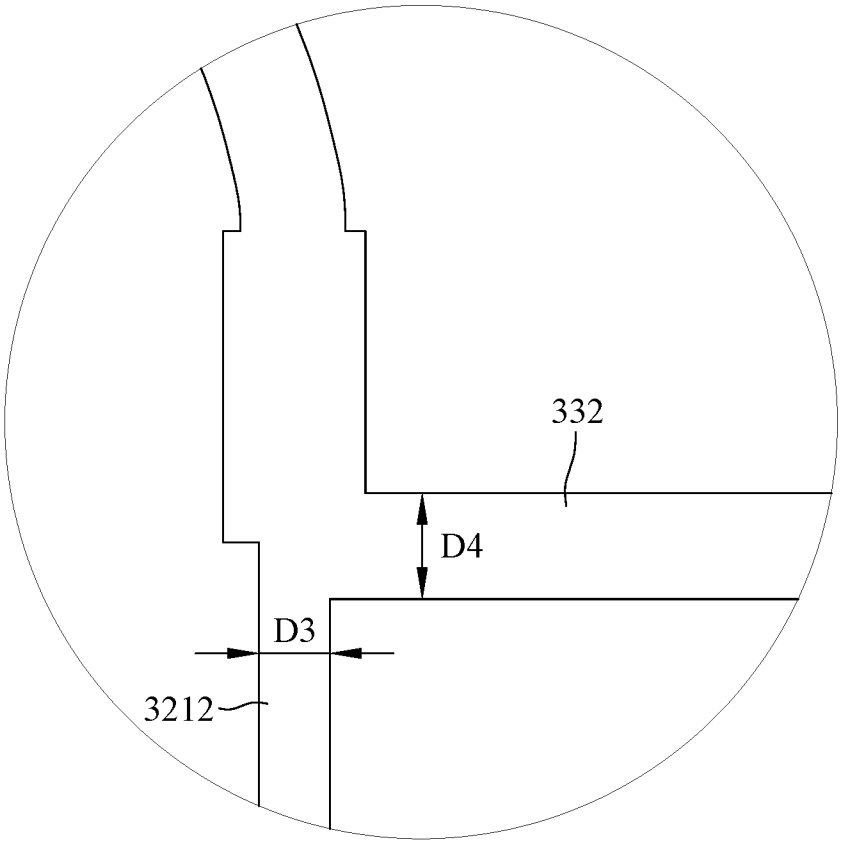
FIG. 5 is a schematic view illustrating the connection point of the second impedance distribution and the impedance converter of the second feed line of the power divider with the second transmission line according to an embodiment of the present invention.
Figure 6:
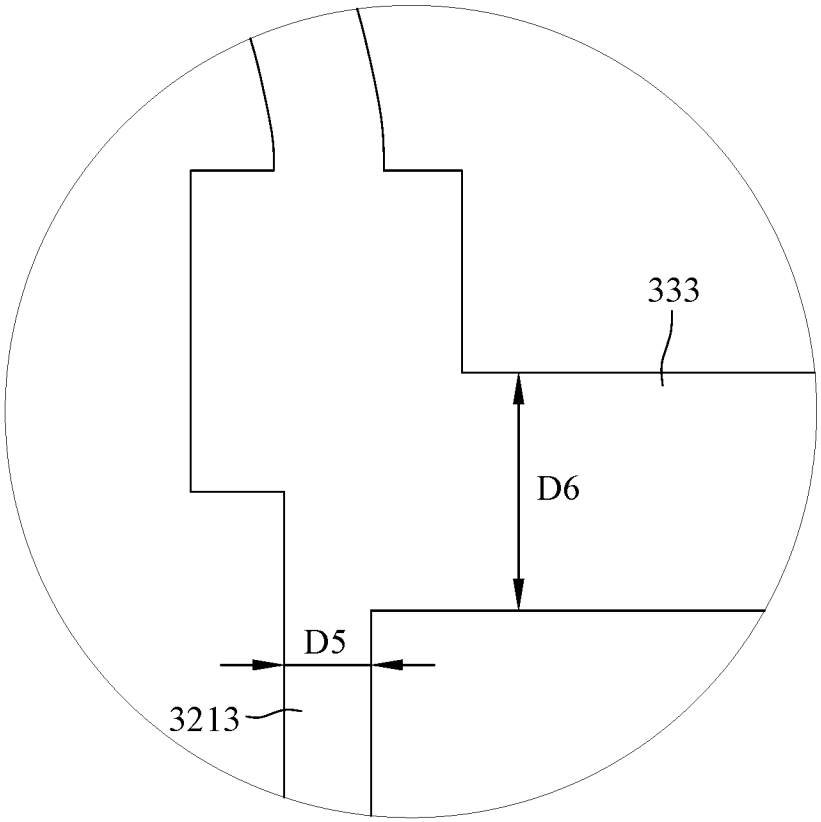
FIG. 6 is a schematic view illustrating the connection point of the third impedance distribution and the impedance converter of the second feed line of the power divider with the third transmission line according to an embodiment of the present invention.

Referring to FIG. 3-FIG. 6, FIG. 3 is a schematic view illustrating the power divider 30 according to an embodiment of the present invention; FIG. 4 is a schematic view illustrating the connection between the first impedance distribution with the impedance converter 3211 of the second feed line 32 of the power divider 30 and the first transmission line 331 according to an embodiment of the present invention; FIG. 5 is a schematic view illustrating the connection point of the second impedance distribution and the impedance converter 3212 of the second feed line 32 of the power divider 30 with the second transmission line 332 according to an embodiment of the present invention; FIG. 6 is a schematic view illustrating the connection point of the third impedance distribution and the impedance converter 3213 of the second feed line 32 of the power divider 30 with the third transmission line 333 according to an embodiment of the present invention. As shown in FIG. 3 to FIG. 6, in a preferred embodiment, the second feed line 32 comprises a plurality of impedance distribution and impedance converters 321, the impedance distribution and impedance converters 321 are respectively connected to the transmission lines 33; by adjusting the line width relationship among the transmission lines 33 connected with the impedance distribution and impedance converters 321, the output power of the transmission lines 33 can be made to gradually decrease from the middle of the second feed line 32 to the two ends of the second feed line 32.

More specifically, as shown in FIG. 3 to FIG. 6, the second feed line 32 is divided into six impedance distribution and impedance converters 321, and the two impedance distribution and impedance converters 321 connected to the first transmission lines 331 are defined as two first impedance distribution and impedance converters 3211, the two impedance distribution and impedance converters 321 connected to the second transmission lines 332 are defined as two second impedance distribution and impedance converters 3212, and the two impedance distribution and impedance converter 321 connected to the third transmission lines 333 are defined as two third impedance distribution and impedance converter 3213.

By adjusting the first line width ratio between the line width D1 of each first impedance distribution and impedance converter 3211 and the line width D2 of each first transmission line 331, the output power of the first transmission line 331 and the sum of the output power of the second transmission line 332 and the third transmission line 333 and the fourth transmission line 334 can be adjusted. By adjusting the second line width ratio of the line width D3 of each second impedance distribution and impedance converter 3212 to the line width D4 of each second transmission line 332, the output power of the second transmission line 332 and the sum of the output power of the third transmission line 333 and the fourth transmission line 334 can be adjusted. By adjusting the third line width ratio of the line width D5 of each third impedance distribution and impedance converter 3213 to the line width D6 of each third transmission line 333, the output power of the third transmission line 333 and the output power of the fourth transmission line 334 can be adjusted. According to the derivation of the S-parameter formula to evaluate the power divider 30, S21=10*log(p2/p1), S31=10*log(p3/p1), S41=10*log(p4/p1), S51=10*log(p5/p1), wherein p1 represents the input power of the feeding port 31, p2 represents the output power of the first transmission line 331, p3 represents the output power of the second transmission line 332, p4 represents the output power of the third transmission line 333, and p5 represents the output of the fourth transmission line 334 power. Assume that p1=1, p2=10^(S21/10)=0.159, p3=10^(S31/10)=0.120, p4=10^(S41/10)=0.062, p5=10^(S51/10)=0.039. Therefore, according to the design of S21, S31, S41, S51, the following can be obtained, p2:p3:p4:p5=1:0.75:0.39:0.24 by adjusting the first, second and third line width ratios. Hereinafter, the actual application of the antenna for suppressing the gain of the side lobes of the present invention installed in the sensor will be further explained.

First, the current enters the second feed line 32 through the feeding port 31. Then, the current passing through the second feed line 32 is distributed to the transmission lines 33 with different output powers according to the length of the flow path and by adjusting the line width ratio of the impedance distribution and impedance converter 321 and the connected transmission line 33. The flow path length refers to the length of the current from the feeding port 31 through the impedance distribution and impedance converters 321 of the second feed line 32 to the transmission lines 33, and the line width ratio refers to the ratio of the line width of the impedance distribution and impedance converter 321 to the line width of the transmission lines 33. Then, the current passing through the transmission lines 33 is output to the first feed lines 21. Furthermore, the current passing through the first feed lines 21 is distributed to the radiating elements 22 according to the width ratio of the radiating elements 22. Finally, the radiating elements 22 generate different resonance currents according to different width ratios, leading to generating radiant energy of different intensities.

The sensor equipped with the antenna for suppressing the gain of the side lobes of the present invention can sense the distance and speed of the target using electromagnetic waves. The sensor can be a vehicle radar, so the antenna for suppressing the gain of the side lobes of the present invention uses the principle of frequency modulated continuous wave (FMCW) to detect the distance and speed of the target.

The following compares the radiation patterns of the antenna for suppressing the gain of the side lobes of the present invention and the conventional antenna, in conjunction with the drawings.

Figure 7:
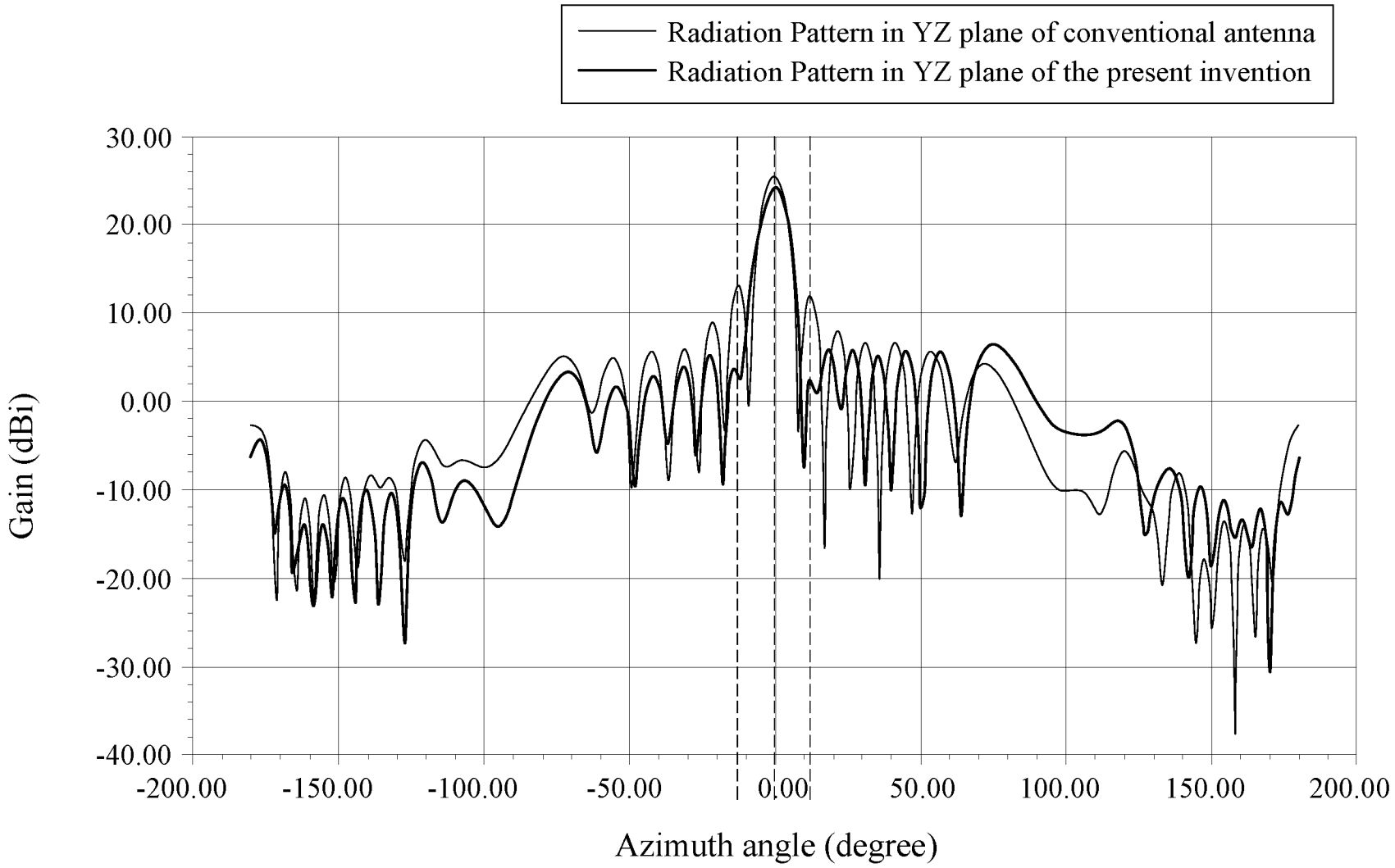
FIG. 7 is a schematic view illustrating the comparison of the radiation pattern of the YZ plane between a conventional antenna and the antenna for suppressing the gain of the side lobes according to an embodiment of the present invention.

Refer to FIG. 7. FIG. 7 is a schematic view illustrating the comparison of the radiation pattern of the YZ plane between a conventional antenna and the antenna for suppressing the gain of the side lobes according to an embodiment of the present invention. The X-axis is the angle of the azimuth angle, the unit is "degrees"; the Y-axis is the gain, the unit is "dBi". The maximum gain appears at the azimuth angle of 0 degrees, and the waveform passing through the azimuth angle of 0 degrees is the main lobe, the two adjacent waveforms neighboring the main lobe are side lobes, with one side lobe located at a negative azimuth angle, and the other side lobe located at a positive azimuth angle.

As shown in FIG. 7, the YZ plane radiation pattern of the conventional antenna has a main lobe gain of approximately 25.41 dBi, and the YZ plane radiation pattern of the antenna for suppressing the side lobe gain of the present invention has a main lobe gain is about 24.17 dBi. The gain the main lobe drops by about 1.24 dBi in the YZ plane radiation pattern of the antenna for suppressing the gain of the side lobes of the present invention, compared to the conventional antenna.

Also as shown in FIG. 7, the gain of the side lobe of the negative azimuth angle of the radiation pattern of the YZ plane of the conventional antenna is about 13.11 dBi, and the gain of the side lobe of the negative azimuth angle of the radiation pattern of the YZ plane of the antenna for suppressing the gain of the side lobe of the present invention is about 3.18 dBi. Therefore, the gain of the side lobe of the negative azimuth angle of the YZ plane of the antenna for suppressing the gain of the side lobe of the present invention is reduced by about 9.93 dBi, compared to the gain of the side lobe of the negative azimuth angle of the radiation pattern of the YZ plane of the conventional antenna.

Also as shown in FIG. 7, the gain of the side lobe of the positive azimuth angle of the radiation pattern of the YZ plane of the conventional antenna is about 11.98 dBi, and the gain of the side lobe of the positive azimuth angle of the radiation pattern of the YZ plane of the antenna for suppressing the gain of the side lobe of the present invention is about 2.38 dBi. Therefore, the gain of the side lobe of the positive azimuth angle of the YZ plane of the antenna for suppressing the gain of the side lobe of the present invention is reduced by about 9.6 dBi, compared to the gain of the side lobe of the positive azimuth angle of the radiation pattern of the YZ plane of the conventional antenna.

As seen from the comparison result of FIG. 7, the antenna for suppressing the gain of the side lobe of the present invention and the conventional antenna have almost the same area range around the maximum radiation direction of the main lobe of the YZ plane. However, compared with the conventional antenna, the antenna for suppressing the gain of the side lobes of the present invention can indeed suppress the gain of the side lobes of the YZ plane (i.e., vertical surface). The reason is: the widths of the radiating elements 22 gradually decrease from the middle of the first feed line 21 to the ends of the first feeding line 21. The wider the width of the radiating elements 22, the stronger the radiated energy; and the narrower the width of the radiating elements 22, the weaker the radiated energy is. As a result, the electromagnetic waves generated by the tandem antenna units 20 decrease from the middle to the opposite ends, so that the antenna for suppressing the gain of side lobes of the present invention can suppress the gain of the side lobes in the YZ plane (i.e., the vertical plane).

Figure 8:
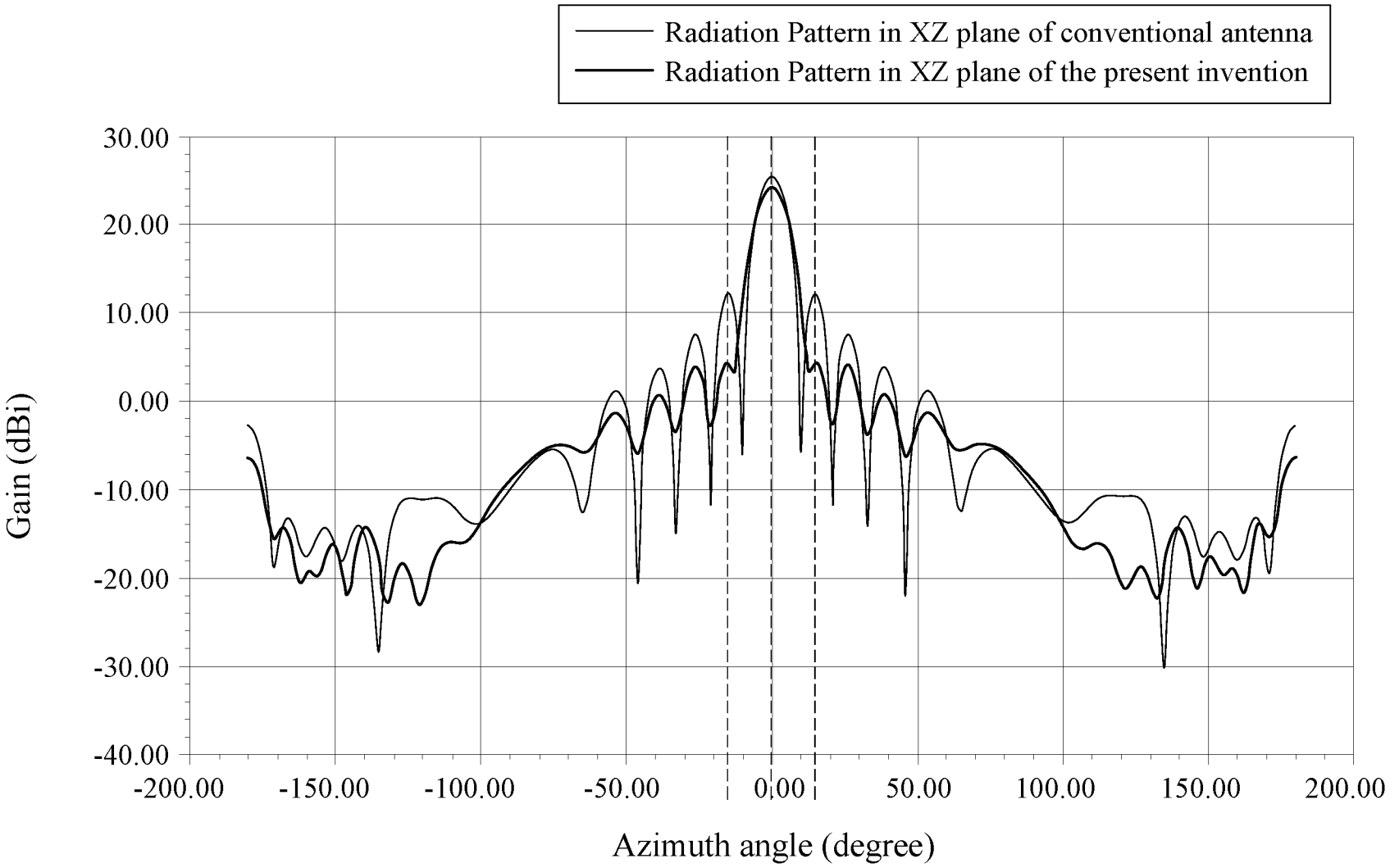
FIG. 8 is a schematic view illustrating the comparison of the radiation pattern of the XZ plane between a conventional antenna and the antenna for suppressing the gain of the side lobes according to an embodiment of the present invention.

Refer to FIG. 8. FIG. 8 is a schematic view illustrating the comparison of the radiation pattern of the XZ plane between a conventional antenna and the antenna for suppressing the gain of the side lobes according to an embodiment of the present invention. The X-axis is the angle of the azimuth angle, the unit is "degrees"; the Y-axis is the gain, the unit is "dBi". The maximum gain appears at the azimuth angle of 0 degrees, and the waveform passing through the azimuth angle of 0 degrees is the main lobe, the two adjacent waveforms neighboring the main lobe are side lobes, with one side lobe located at a negative azimuth angle, and the other side lobe located at a positive azimuth angle.

As shown in FIG. 8, the XZ plane radiation pattern of the conventional antenna has a main lobe gain of approximately 25.41 dBi, and the XZ plane radiation pattern of the antenna for suppressing the side lobe gain of the present invention has a main lobe gain is about 24.17 dBi. The gain the main lobe drops by about 1.24 dBi in the XZ plane radiation pattern of the antenna for suppressing the gain of the side lobes of the present invention, compared to the conventional antenna.

Also as shown in FIG. 8, the gain of the side lobe of the negative azimuth angle of the radiation pattern of the XZ plane of the conventional antenna is about 12.13 dBi, and the gain of the side lobe of the negative azimuth angle of the radiation pattern of the XZ plane of the antenna for suppressing the gain of the side lobe of the present invention is about 4.25 dBi. Therefore, the gain of the side lobe of the negative azimuth angle of the XZ plane of the antenna for suppressing the gain of the side lobe of the present invention is reduced by about 7.88 dBi, compared to the gain of the side lobe of the negative azimuth angle of the radiation pattern of the XZ plane of the conventional antenna.

Also as shown in FIG. 8, the gain of the side lobe of the positive azimuth angle of the radiation pattern of the XZ plane of the conventional antenna is about 12.15 dBi, and the gain of the side lobe of the positive azimuth angle of the radiation pattern of the XZ plane of the antenna for suppressing the gain of the side lobe of the present invention is about 4.19 dBi. Therefore, the gain of the side lobe of the positive azimuth angle of the XZ plane of the antenna for suppressing the gain of the side lobe of the present invention is reduced by about 7.96 dBi, compared to the gain of the side lobe of the positive azimuth angle of the radiation pattern of the XZ plane of the conventional antenna.

As seen from the comparison result of FIG. 8, the antenna for suppressing the gain of the side lobe of the present invention and the conventional antenna have almost the same area range around the maximum radiation direction of the main lobe of the XZ plane. However, compared with the conventional antenna, the antenna for suppressing the gain of the side lobes of the present invention can indeed suppress the gain of the side lobes of the XZ plane (i.e., horizontal surface). The reason is: because the output power of the transmission lines 33 gradually decreases from the middle of the second feed line 32 to both ends of the second feed line 32, the shorter the current flow path, the larger the ratio of the line width between the impedance distribution and impedance converter 321 of the second feed line 32 and the transmission lines 33 the greater the output power obtained by the transmission lines 33. The longer the current flow path, the smaller the line width ratio of the impedance distribution and impedance converter 321 of the second feed line 32 and the transmission line 33, the smaller the output power obtained by the transmission lines 33. As a result, the output power from the power divider 30 decreases from the middle to the two ends. Therefore, the antenna for suppressing the gain of the side lobes of the present invention can suppress the gain of the side lobes in the XZ plane (i.e., the azimuth plane).

In summary, the antenna for suppressing the gain of side lobes according to the present invention can effectively suppress both the gain of side lobes in the YZ plane (i.e., vertical surface) and the gain of the side lobes in the XZ plane (i.e., azimuth plane) to improve the resolution of detecting targets.

Furthermore, the power divider 30 only needs a single feeding port 31 to integrate a plurality of serially tandem antenna units, which has a simple structure and low manufacturing cost.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An antenna for suppressing gain of side lobes, comprising:

a substrate;

a plurality of tandem antenna units, the tandem antenna units being arranged on the substrate at intervals, and each comprising a first feed line and a plurality of radiating elements; the radiating elements being arranged at intervals on the first feed line, and each radiating element being rectangular; widths of the radiating elements gradually decreasing from middle of the first feed line to two ends of the first feed line; and a power divider; the power divider being arranged on the substrate and comprising a feeding port, a second feed line and a plurality of transmission lines, each transmission line having a line width and being connected to a respective first feed line; middle of the second feed line being connected to the feeding port; the transmission lines being respectively connected to the second feed line and arranged at intervals;

wherein the transmission lines form two output combinations from the middle of the second feed line to two ends of the second feed line, each output combination comprises at least four transmission lines including a first transmission line, a second transmission line, a third transmission line, and a fourth transmission line distributed from the middle of the second feed line to one end of the second feed line;

wherein the second feed line comprises two first impedance distribution and impedance converters respectively connected to the two first transmission lines, two second impedance distribution and impedance converters respectively connected to the two second transmission lines, two third impedance distribution and impedance converters respectively connected to the two third transmission lines;

wherein an output power p1 of the first transmission line and a sum of an output power p2 of the second transmission line, an output power p3 of the third transmission line and an output power p4 of the fourth transmission line are adjusted by adjusting a first ratio of a line width of the first impedance distribution and impedance converter to the line width of the first transmission line;

wherein the output power p2 of the second transmission line and a sum of the output power p3 of the third transmission line and the output power p4 of the fourth transmission line are adjusted by adjusting a second ratio of a line width of the second impedance distribution and impedance converter to the line width of the second transmission line;

wherein the output power p3 of the third transmission line and the output power p4 of the fourth transmission line are adjusted by adjusting a third ratio of a line width of the third impedance distribution and impedance converter to the line width of the third transmission line; and wherein relationship among p1, p2, p3, and p4 being p1:p2:p3:p4=1:0.75:0.39:0.24 is achieved by adjusting the first, second and third ratios.

2. The antenna for suppressing the gain of side lobes according to claim 1, wherein the radiating elements form two radiation combinations from the middle of the first feed line to the two ends of the first feed line, each radiation combination comprises at least six radiating elements, and widths of the at least six radiating elements of each radiation combination decrease gradually from the middle of the first feed line to one end of the first feed line.

3. The antenna for suppressing the gain of side lobes according to claim 2, wherein the at least six radiating elements of each radiation combination are sequentially defined as a first radiating element, a second radiating element, a third radiating element, a fourth radiating element, a fifth radiating element, and a sixth radiating element from the middle of the first feed line to one end of the first feed line; the widths of the first radiating element, the second radiating element, the third radiating element, the fourth radiating element, the fifth radiating element, and the sixth radiating element are respectively defined as W1, W2, W3, W4, W5 and W6, and a relationship among the widths is W1:W2:W3:W4:W5:W6=1.45:1.4:1.23 1.03:0.8:0.7.

4. The antenna for suppressing the gain of side lobes according to claim 2, wherein the at least six radiating elements of each radiation combination are sequentially defined as a first radiating element, a second radiating element, a third radiating element, a fourth radiating element, a fifth radiating element, and a sixth radiating element from the middle of the first feed line to one end of the first feed line; the widths of the first radiating elements are equal, the widths of the second radiating elements are equal, the widths of the third radiating elements are equal, the widths of the fourth radiating elements are equal, the widths of the fifth radiating elements are equal, the widths of the sixth radiating elements are equal, and lengths of all the radiating elements of each tandem antenna unit are equal.

5. An antenna for suppressing gain of side lobes, comprising:

a substrate;

a plurality of tandem antenna units, the tandem antenna units being arranged on the substrate at intervals, and each comprising a first feed line and a plurality of radiating elements; the radiating elements being arranged at intervals on the first feed line, and each radiating element being rectangular; the radiating elements forming two radiation combinations from middle of the first feed line to two ends of the first feed line, each radiation combination comprising at least six radiating elements, the at least six radiating elements of each radiation combination being sequentially defined as a first radiating element, a second radiating element, a third radiating element, a fourth radiating element, a fifth radiating element, and a sixth radiating element from the middle of the first feed line to one end of the first feed line; in each radiation combination, widths of the first radiating element, the second radiating element, the third radiating element, the fourth radiating element, the fifth radiating element, and the sixth radiating element being respectively defined as W1, W2, W3, W4, W5 and W6, and a relationship among the widths is W1:W2:W3:W4:W5:W6=1.45:1.4:1.23:1.03:0.8:0.7; and a power divider; the power divider being arranged on the substrate and comprising a feeding port, a second feed line and a plurality of transmission lines, each transmission line having a line width and being connected to a respective first feed line; middle of the second feed line being connected to the feeding port; the transmission lines being respectively connected to the second feed line and arranged at intervals;

wherein the transmission lines form two output combinations from the middle of the second feed line to two ends of the second feed line, each output combination comprising at least four transmission lines, the at least four transmission lines of each output combination being sequentially defined as a first transmission line, a second transmission line, a third transmission line, and a fourth transmission line from the middle of the second feed line to one end of the second feed line;

wherein the second feed line comprises two first impedance distribution and impedance converters respectively connected to the two first transmission lines, two second impedance distribution and impedance converters respectively connected to the two second transmission lines, two third impedance distribution and impedance converters respectively connected to the two third transmission lines;

wherein an output power p1 of the first transmission line and a sum of an output power p2 of the second transmission line, an output power p3 of the third transmission line and a n output power p4 of the fourth transmission line are adjusted by adjusting a first ratio of a line width of the first impedance distribution and impedance converter to the line width of the first transmission line;

wherein the output power p2 of the second transmission line and a sum of the output power p3 of the third transmission line and the output power p4 of the fourth transmission line are adjusted by adjusting a second ratio of a line width of the second impedance distribution and impedance converter to the line width of the second transmission line;

wherein the output power p3 of the third transmission line and the output power p4 of the fourth transmission line are adjusted by adjusting a third ratio of a line width of the third impedance distribution and impedance converter to the line width of the third transmission line; and wherein a relationship among p1, p2, p3, and p4 being p1:p2:p3:p4=1:0.75:0.39:0.24 is achieved by adjusting the first, second and third ratios.

6. The antenna for suppressing the gain of side lobes according to claim 5, wherein the widths of the first radiating elements are equal, the widths of the second radiating elements are equal, the widths of the third radiating elements are equal, the widths of the fourth radiating elements are equal, the widths of the fifth radiating elements are equal, the widths of the sixth radiating elements are equal, and lengths of all the radiating elements of each tandem antenna unit are equal.

* * * * *